US006273020B1

(12) United States Patent
D'Alessandro

(10) Patent No.: US 6,273,020 B1
(45) Date of Patent: Aug. 14, 2001

(54) RESTRAINT FOR ARTICLES SUCH AS FISHING POLES

(76) Inventor: David A. D'Alessandro, 5 Franklin St., Manchester, CT (US) 06040

( * ) Notice: Subject to any disclaimer, the term of this patent is extended or adjusted under 35 U.S.C. 154(b) by 0 days.

(21) Appl. No.: 09/421,797

(22) Filed: Oct. 20, 1999

(51) Int. Cl.[7] ..... B63B 17/00; B63B 19/00

(52) U.S. Cl. ..... 114/364; 114/201; 24/298; 24/300; 24/301

(58) Field of Search ..... 24/300, 301, 482, 24/673, 674, 675, 676; 114/201 R, 364; 248/499, 500, 505, 506; 410/96, 97, 100

(56) References Cited

U.S. PATENT DOCUMENTS

| | | | | |
|---|---|---|---|---|
| Re. 22,625 | * | 4/1945 | Huelster | 24/217 |
| Re. 22,626 | * | 4/1945 | Huelster | 24/218 |
| 2,328,016 | * | 8/1943 | Huelster | 24/218 |
| 2,441,573 | * | 5/1948 | Huelster | 24/217 |
| 2,606,353 | * | 8/1952 | Huelster | 24/218 |
| 3,325,127 | * | 6/1967 | Doskocil | 248/38 |
| 3,796,404 | * | 3/1974 | Shields | 248/361 R |
| 4,398,306 | * | 8/1983 | Gooding | 2/421 |
| 4,457,553 | * | 7/1984 | Larkin | 296/160 |
| 4,692,969 | * | 9/1987 | Johnson | 24/573 |
| 4,796,339 | * | 1/1989 | Burke | 24/662 |
| 4,986,785 | * | 1/1991 | Flowers | 441/84 |
| 5,845,891 | * | 12/1998 | West | 248/538 |
| 5,956,834 | * | 9/1999 | Sardo et al. | 24/402.15 |
| 6,109,459 | * | 8/2000 | Downey | 211/70.8 |

* cited by examiner

*Primary Examiner*—James R. Brittain
*Assistant Examiner*—Ruth C. Rodriguez
(74) *Attorney, Agent, or Firm*—M. P. Williams

(57) ABSTRACT

A restraint for holding fishing poles to the deck of a boat includes an anchor screwed to the deck, a unidirectional snap fastener having its base portion screwed to the deck, and a double strand of bungee cord or other resilient strand extending from the anchor to a cap of the snap fastener. The unidirectional snap fastener is oriented so that no amount of force pulling up on the bungee cord will release the snap fastener, but a slight tug on a side of the snap fastener opposite to the anchor will easily cause it to release. The cap of the snap fastener includes a looped tab to facilitate separating it from the base. The anchor may be secured in the end wall of a hatch cover; the snap fastener may be secured adjacent to a gunwale.

7 Claims, 3 Drawing Sheets

RESTRAINT FOR ARTICLES SUCH AS FISHING POLES

TECHNICAL FIELD

This invention relates to a restraint in which bungee (stretchable) cord is anchored to a surface at one end, and has a unidirectional snap fastener at the other end, whereby pulling on the bungee cord cannot release the snap, but pulling on a side of the snap opposite the bungee cord will release it.

BACKGROUND ART

An example for the need of a restraint for securely holding articles in place, while at the same time allowing quick access thereto, is found in tournament bass fishing. In tournament bass fishing, anglers have a limited amount of time in which to produce the best catch, thereby to win the tournament. Common practice is to fish, successively, at different spots seeking an adequate catch. Because of the time constraint, anglers in a bass tournament have many different poles, rigged and ready for use. Anglers typically use high speed boats so as to reduce the time required to travel from one fishing spot to the next, frequently encountering rough water, created by wind and/or other boats. When traveling from spot to spot, it is desirable to not restore rigged fishing poles to a pole locker, it being preferred to keep them readily accessible on deck. To hold the pole securely while traveling, some sort of restraint is required. Since some of the poles are extremely large, up to eight feet in length, the common practice is to secure poles to the forward deck of a bass boat when traveling.

Restraints for fishing poles known to the prior art have been inadequate. One restraint simply uses VELCRO to hold fishing poles to the deck of a boat. However, the VELCRO does not hold adequately. Another restraint uses an elastic strap which is secured with a hook and eye combination. However, this combination stands out from the deck and poses a safety hazard with the potential of tripping an angler, and/or injuring an angler that steps on the hook/eye combination. Another restraint utilizes a T-shaped slot embedded in the deck. However, slots have a tendency to fill with matter and become blocked.

DISCLOSURE OF INVENTION

Objects of the invention include provision of a restraint for holding articles, such as fishing poles, securely to a surface which: will not be released in response to pressure from the article being held; which is easily released by a person; which is simple, low cost and easy to install; and which does not comprise a hazard to persons in its vicinity.

According to the present invention, a restraint for articles, such as fishing poles, comprises one or more lengths of resilient cord, such as bungee cord, permanently anchored at one end by a suitable fastener, such as a screw, and secured at the opposite end by means of a unidirectional snap fastener, positioned so that no amount of pressure on the bungee cord can release the snap fastener, but pressure on the snap fastener at a position opposite to the bungee cord will cause it to readily release. In accordance further with the invention, a restraint comprises a length of resilient cord folded back on itself, the two ends thereof being fastened together, such as by whipping or otherwise, so as to form a loop, one end of the loop being captured within the cap portion of a unidirectional snap fastener, the other end of the loop to be secured to a surface to which the restraint is to be mounted, the restraint including the body portion of a unidirectional snap fastener, which is to be secured to said surface. According to a particular embodiment of the present invention, a restraint for fishing poles comprises a length of bungee cord, which may be a single strand or plural strands, having one end secured to the deck of a boat, the other end captured in the cap of a unidirectional dot fastener, and the body of said dot fastener being secured to said deck. In further accord with this embodiment, the restraint is secured athwart said deck. In further accord with the invention, the restraint is secured with the unidirectional snap fastener adjacent to the gunwale of the boat, thereby to reduce contact thereof with anglers' feet. In accordance still further with the invention, one end of the restraint may be anchored in the edge of a hatch cover, thereby to avoid contact with anglers' feet.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
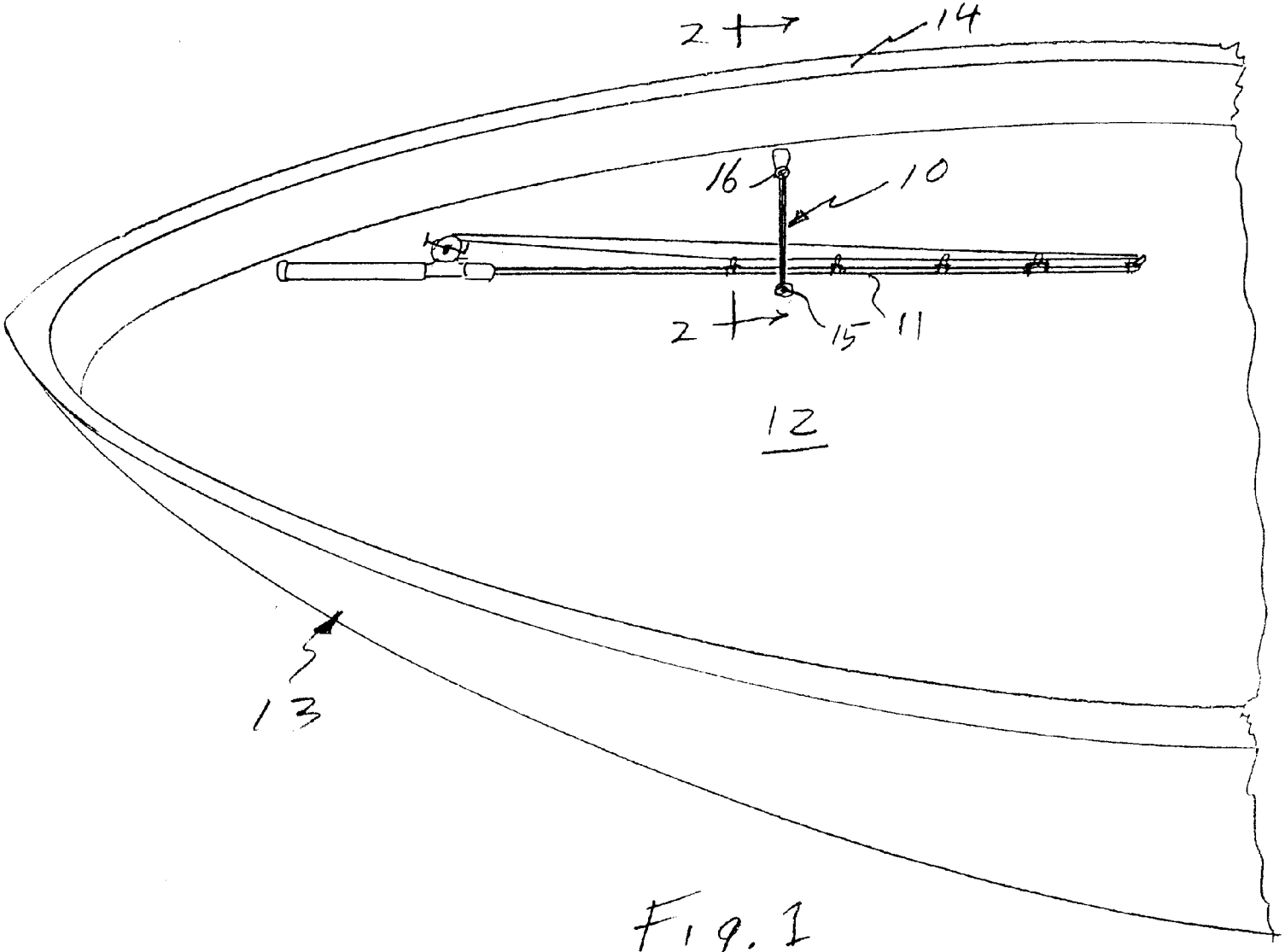
FIG. 1 is a partial, perspective view of the deck of a boat with a restraint of the invention holding a fishing rod to the deck of the boat.

Referring to FIG. 1, a restraint 10 according to the invention is illustrated holding a fishing pole 11 to the deck 12 of a bass boat 13 which has a gunwale 14. The restraint 10 includes an anchor 15 at one end and a unidirectional snap fastener 16 at another end.

Figure 3:
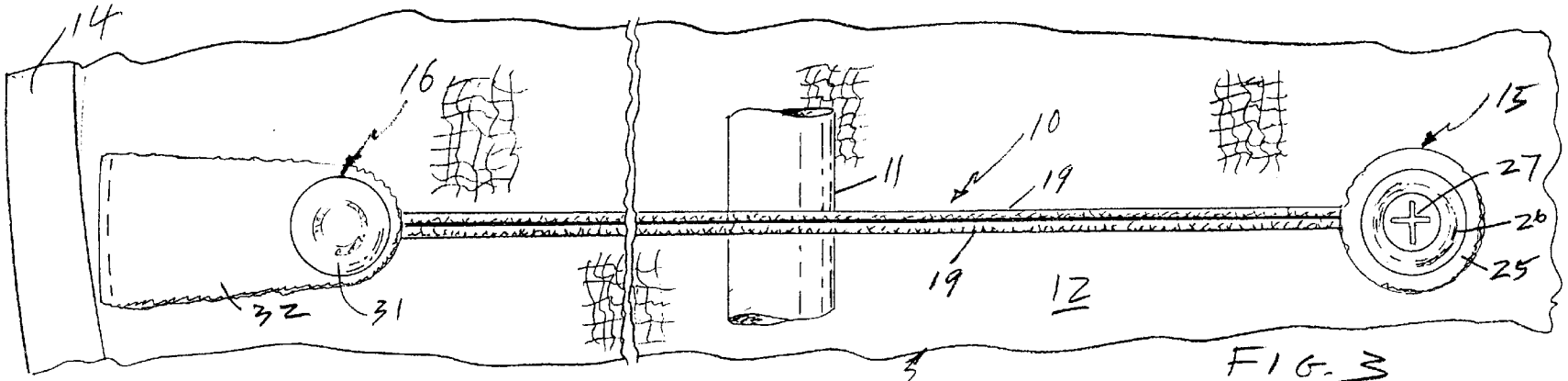
FIG. 3 is a partial, top plan view of the boat and deck of FIGS. 1 and 2.
Figure 2:
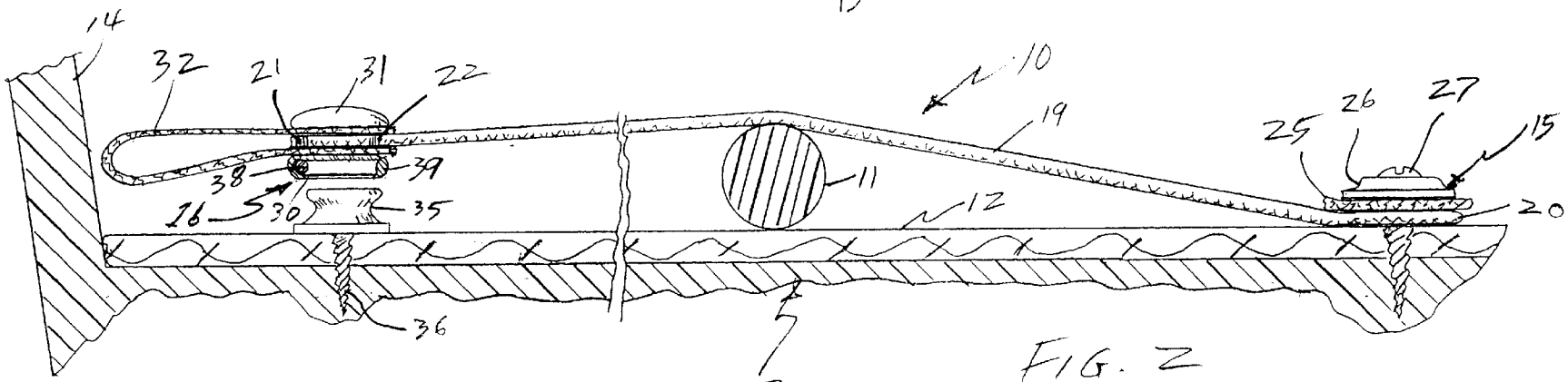
FIG. 2 is a partial, partially sectioned, front elevation view of the restraint of FIG. 1, taken on the line 2—2 in FIG. 1.

In FIGS. 2 and 3, one embodiment of the restraint of the invention includes a single strand of bungee cord 19 folded upon itself so as to form a loop 20 at one end of the restraint 10, the two ends of which can be secured together at two separated points 21, 22, such as by whipping, or by means of small hog rings, or the like. The loop 20 is captured beneath the anchor 15, which in this embodiment comprises a washer 25 of leather or thick vinyl to protect the bungee cord 19 from chafing, a finishing washer 26, and a screw 27. In this embodiment, the deck 12 of the boat comprises carpeting, and therefore the screw 27 must be of sufficient length to reach to the plastic of the boat proper, there beneath. The other end of the bungee cord 19 is secured within the cap portion of the unidirectional snap fastener 16, notably between a snap portion 30 and a crown portion 31. The bungee cord 19 is cushioned within the snap fastener 16 by two layers of leather or heavy vinyl which are formed of a loop of leather or vinyl forming a tab 32, which assists in releasing the restraint, when desired. The ends of the bungee cord could be reversed, with the loop 20 captured in the snap fastener 16. The snap fastener 16 also has a base portion 35 which is fastened to the deck 12 by means of a screw 36.

Figure 4:
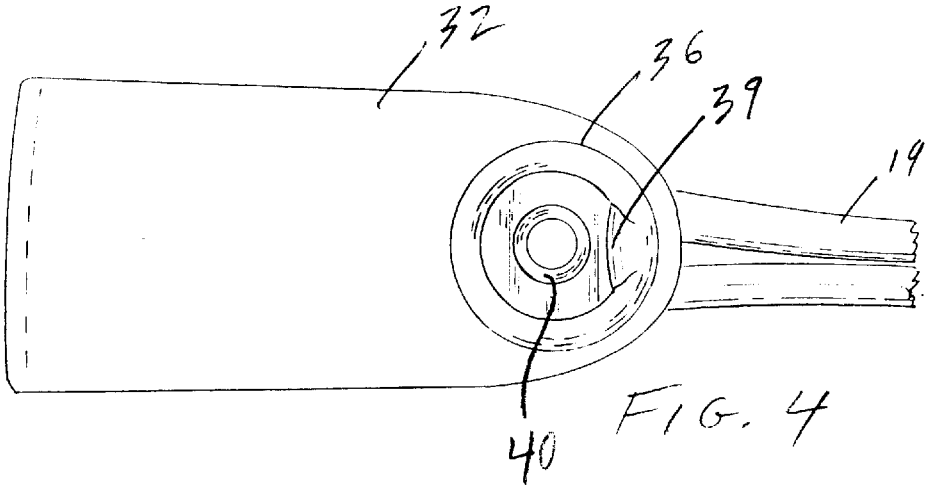
FIG. 4 is a partial, bottom plan view of a unidirectional snap fastener.

Referring to FIG. 2 and FIG. 4, the snap portion 30 has a circular expansion spring 38 extending around about threequarters of the internal periphery thereof, and a boss or land 39 extending over less than a quarter of the internal periphery thereof. Because the land portion 39 is unyielding, the cap 30 may be secured to the base 35 only by first inserting the land or boss 39 into the groove of the base 35, and then pressing the remainder of the cap 30 in place, the spring 38 yielding sufficiently to allow the two pieces to be joined, after which the spring 38 settles in the groove of the base portion 35. To remove the cap 30 from the base 35, the side of the cap 30 opposite to the land or boss 39 must first be pulled away from the base 35, the spring 38 yielding sufficiently so that it will clear the groove 35, after which the entire cap can be removed from the base 30 by means of a slight motion toward the land or boss 39. The crown 31 is secured to the snap portion 30 by an integral hollow rivet 40. A suitable unidirectional snap fastener is available under the tradename, DOT.

An important aspect of the present invention is that no amount of pulling upwardly on the bungee cord 19 will cause the cap 30 to be released from the base 35, but a slight tug on the opposite side of the cap 30, such as by means of the tab 32, will easily release the cap 30 from the base 35. Therefore, once the snap fastener is properly engaged, pressure induced on the restraint by the things being restrained thereby, such as one or more fishing poles, will not cause the restraint to become unfastened. And yet, the angler can easily get at fishing poles by simply pulling upwardly on the tab 32. If desired, a loop of cord may be passed through the tab 32 to make it easier to grasp.

Figure 5:
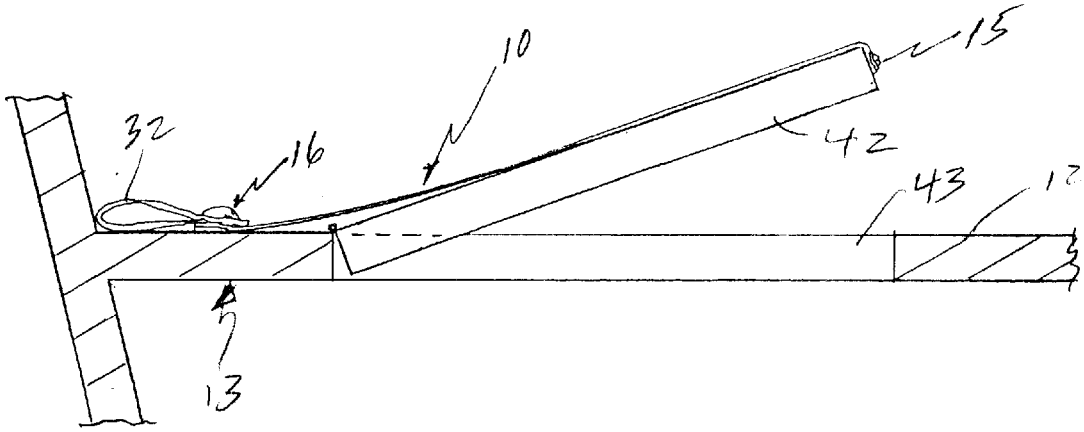
FIG. 5 is a partial, partially sectioned side elevation view of a restraint of the invention mounted to a hatch cover.

An advantage of the present invention, which can be seen in FIG. 5, is that the unidirectional snap fastener extends only slightly above the deck, and poses no serious hazard, such as tripping over or stepping on it. If the snap fastener is mounted at the edge of the deck 12 near the gunwale 14, it is even less of a hazard. If desired, the anchor 15 can be mounted in the edge of a hatchway cover 42 at the entrance 43 to a locker or other space, thereby removing the anchor 15 from the deck surface entirely.

The embodiment described utilizes a piece of bungee cord folded upon itself so that there are two strands of bungee cord between the anchor 15 and the unidirectional snap fastener 16. On the other hand, a single strand of bungee cord, even more strands of bungee cord, or other resilient strands may be used if desired. In a typical embodiment for use in holding fishing poles to the deck of a bass boat, the bungee cord may be any conventional cord on the order of 3/16 inch in diameter.

The invention has been described as a restraint in an embodiment for holding fishing poles to the deck of a bass boat. However, the restraint of the present invention may be utilized in a wide variety of embodiments, used with surfaces which are not horizontal, and used to hold things against or within boxes or other objects, as may be appropriate in wide variety of circumstances.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A restraint for releasably securing articles to an object comprising:

a resilient cord;

an anchor for securing one end of said resilient cord to a first surface area of said object; and a unidirectional snap fastener for securing another end of said cord to a second surface area of said object, said fastener including a base fastened to said object and a cap fastened to said resilient cord for releasably engaging said base, said unidirectional snap fastener being oriented with respect to said resilient cord so that pressure applied to said cap by said resilient cord will not release said cap from said base, whereas pressure applied to said cap at a side of said cap opposite from said resilient cord will readily release said cap from said base.

2. A restraint according to claim 1 wherein said first surface area and said second surface area are disposed on a same surface.

3. A restraint according to claim 1 wherein said resilient cord comprises a plurality of strands extending between said cap and said anchor.

4. A boat having a deck and a restraint according to claim 1 fastened to surface areas of said deck.

5. A boat according to claim 4 wherein said anchor and said base are both fastened to said deck.

6. A boat according to claim 4 wherein said deck includes a hatch cover, and said anchor is fastened to an edge of said hatch cover.

7. A boat according to claim 4 wherein said boat has a gunwale, and said base is fastened to said deck adjacent to said gunwale.

* * * * *